US005718381A

United States Patent [19]

Katzer et al.

[11] Patent Number: 5,718,381

[45] Date of Patent: Feb. 17, 1998

[54] SPRINKLER FOR DISCHARGING A FLUID

[75] Inventors: Johann Katzer, Neu-Ulm; Franz Lopic, Nersingen; Lothar Mitzlaff, Ulm, all of Germany

[73] Assignee: Gardena Kress + Kastner GmbH, Germany

[21] Appl. No.: 518,916

[22] Filed: Aug. 24, 1995

[30] Foreign Application Priority Data

Aug. 24, 1994 [DE] Germany ..... 44 29 952.4

[51] Int. Cl.[6] ..... B05B 3/02

[52] U.S. Cl. ..... 239/222.11; 239/230; 239/383; 239/204

[58] Field of Search ..... 239/200, 201, 239/203, 204, 206, 222.11, 222.13, 222.15, 222.17, 230, 233, 240, 24, 244, 251, 383, 498, 501, 581, 586

[56] References Cited

U.S. PATENT DOCUMENTS

| | | | |
|---|---|---|---|
| Re. 32,386 | 3/1987 | Hunter | 239/206 |
| 3,521,822 | 7/1970 | Friedmann et al. | 239/206 |
| 3,567,126 | 3/1971 | Martini | 239/206 |
| 3,602,431 | 8/1971 | Lockwood | 239/101 |
| 3,648,933 | 3/1972 | Grotz | 239/377 |
| 3,854,664 | 12/1974 | Hunter | 239/206 |
| 4,474,328 | 10/1984 | Hale | 239/227 |
| 4,712,738 | 12/1987 | Gill | 239/581.1 |
| 4,754,925 | 7/1988 | Rubinstein | 239/230 |
| 4,805,838 | 2/1989 | Greenberg | 239/222.17 |
| 4,819,872 | 4/1989 | Rosenberg | 239/581.1 |
| 4,944,456 | 7/1990 | Zakai | 239/222.19 |
| 4,967,961 | 11/1990 | Hunter | 239/240 |
| 4,986,474 | 1/1991 | Schisler et al. | 239/206 |
| 5,007,586 | 4/1991 | Cohen | 239/222.17 |
| 5,058,806 | 10/1991 | Rupar | 239/206 |
| 5,224,653 | 7/1993 | Nelson et al. | 239/222.11 |
| 5,372,307 | 12/1994 | Sesser | 239/222.17 |
| 5,415,348 | 5/1995 | Nelson | 239/222.11 X |
| 5,439,174 | 8/1995 | Sweet | 239/222.17 |

FOREIGN PATENT DOCUMENTS

| | | |
|---|---|---|
| 316930 | 5/1989 | European Pat. Off. . |
| 1281736 | 10/1968 | Germany . |

*Primary Examiner*—Andres Kashnikow
*Assistant Examiner*—Lisa Ann Douglas
*Attorney, Agent, or Firm*—Quarles & Brady

[57] ABSTRACT

In a circular sprinkler, as a result of an intermediate gear, the turbine wheel runs muck faster than the jet splitter operating upstream thereof in the flow direction and also constructed as a turbine rotor, so that the sprinkler starts substantially independently of the water flow and an adjusting device can be provided with which it is possible at any time to manually adjust the sector to be watered. A slot-like bottom with an extension of the guide faces connected thereto is used for further increasing efficiency.

33 Claims, 3 Drawing Sheets

SPRINKLER FOR DISCHARGING A FLUID

BACKGROUND OF THE INVENTION

The invention relates to a sprinkler with which a fluid, particularly water, can be discharged in a trajectory in such a way that it is possible to water by precipitation a relatively large area of several square meters. The fluid is appropriately discharged into the open roughly horizontally or in upwardly inclined manner from the fluid outlet and then passes under the discharge energy over a curved trajectory onto the ground.

The sprinkler is advantageously constructed as a circular sprinkler, which distributes the water in a circular arc around it by one or more rotating or fixed guide bodies, the arc having an arc or sector angle of 360° or less, e.g. max 45°. On leaving the sprinkler the water is fanned out by the guide body means, namely, e.g. being firstly divided up and fanned out in slot-like conduits to form individual and separate water jets which are adjacent in the arc direction and then in said jets by means of interfering members or the like further fanning and dividing is possible if the rotation or some other movement of the guide body transversely to the water jet is too rapid, then the latter is excessively scattered and the range or trajectory distance is correspondingly decreased. These disadvantages increase with the water pressure if the velocity of motion is dependent on the pressure of the mains water supplied to the sprinkler it is admittedly conceivable to so drive a driven rotor by means of a centrifugal clutch by a driving rotor that in a starting phase the driven rotor is not driven and consequently the two rotors in the starting phase initially perform a relative movement with respect to one another, but the rotors on reaching the limit speed are then interconnected positively by means of the centrifugal clutch, so that in the substantially constant discharge operation following the starting phase this relative movement no longer exists and then the indicated disadvantages occur.

OBJECTS OF THE INVENTION

An object of the invention is to provide a sprinkler in which the disadvantages of known constructions or of the described manner are avoided and which in particular at least partly independently of the supplied water pressure ensures a high efficiency or in precisely determinable manner a high sprinkling density, as well as a very considerable sprinkling width, optionally over varyingly large sprinkling sectors.

SUMMARY OF THE INVENTION

According to the invention two bodies or surfaces influencing the fluid flow in an approximately uniformly continuing discharge operation have a relative movement to one another, so that there are constantly changing relative positions of the two bodies and consequently the water jet or jets on leaving the sprinkler are constantly differently fanned out or scattered.

It is particularly appropriate if both guide bodies with respect to a base or socket of the sprinkler continuously perform an equidirecttonal or continuous or other working movement and if the upstream guide body or water jet parts have a much lower velocity of motion optionally passing towards zero than the immediately following guide body, which directly takes over the water jets from the upstream guide body. The following or downstream guide body has the last surfaces which can be subject to the action of the water before it is released into the trajectory by the sprinkler.

The movement of the downstream guide body can be at least 10 to 20 or at least 30 or 40 times faster than that of the upstream guide body, so that the latter delivers the water jet in relatively strongly focussed form and consequently acts in relatively high energy manner on the downstream guide body or is driven by the water jets. The water jets can be so guided on the upstream guide body that by recoil they exert thereon a driving torque in the sense of a working movement, which further increases efficiency. It is admittedly possible to provide more than two flow direction-following guide bodies, e.g. of the two aforementioned types moving constantly or intermittently with respect to the base, but it is also advantageous to only combine two guide bodies in a discharge head forming the fluid outlet or outlets.

Appropriately one guide body drives a further guide body or at least determines its velocity of motion, e.g. in that the two guide bodies are drive-connected. The driven guide body can also produce a driving torque. For drive connection purposes it is advantageous to provide a gear, particularly a compact reduction gear only having two rolling areas allowing one guide body to move roughly 50 times slower than the other. The rolling areas can be partly or completely located within the downstream guide body, e.g. of a turbine wheel, which forms the widest area of the discharge head and from whose water-exposed driving surfaces or turbine blades the water passes into the free trajectory.

Independently of the described construction means can be provided so that, by an adjusting movement, the watered sector can be reversibly increased or decreased with respect to the the trajectory, in particular without having to remove or add parts for this purpose.

According to the invention between the fluid inlet and fluid outlet of the sprinkler on the base receiving in fixed manner the mounting support for the control or guide body is provided an adjusting device, with which it is possible to carry out such adjustments manually during the discharge operation, without the operator exposing himself to the water jets passing out. The adjusting device advantageously has a control face with directly adjacent, varyingly large control openings and a control face movable with respect thereto for the gradual partial or complete closing of the control opening. In the direction of the control movement the control openings at least one boundary can have roughly the same width or, at right angles to the control movement, can have stepped different transverse extensions, so that in place of a multipart closing surface with surface parts movable against one another it is sufficient to have a one-part closing surface with common, movable surface parts, in order to open the particular control opening completely, close it completely or close it to only part of its transverse extension. As a result the sum of the opened passage cross-sections of the control openings with at least two to all the different settings can be approximately constant, so that there are correspondingly constant pressure conditions or flow quantities.

The construction according to the invention is suitable for both sprinklers which are to be installed in axially fixed manner and also for surface-flush sprinklers, in which the discharge head or base is mounted axially or is vertically extendable and retractable, e.g. under the action of the pressure of the water supplied. The adjusting means are also appropriately provided on the displaceable unit, particularly directly below the discharge head, so that the water flows through the handle and leaves same at the top in substantially contact-free manner, namely being guided through the upstream guide body.

BRIEF FIGURE DESCRIPTION

These and further features can be gathered from the claims, description and drawings and the individual features.

both individually and as subcombinations, can be implemented in an embodiment of the invention and in other fields and can represent advantageous, independently protectable constructions for which protection is hereby claimed. Embodiments of the invention are described in greater detail hereinafter relative to the drawings, wherein show:

FIG. 1 A sprinkler according to the invention in part axially sectional view.

FIG. 2 A guide body of a sprinkler in a view of the bottom.

FIG. 3 The adjusting device of the sprinkler of FIG. 1 in axial section.

FIG. 4 The adjusting device of FIG. 3 in a further position.

FIG. 5 A further guide body in axial section.

FIG. 6 A cross-section through guide faces of the guide body of FIG. 5.

FIG. 7 A further construction of a discharge head.

DETAILED DESCRIPTION OF PREFERRED EXAMPLE EMBODIMENTS

Figure 1:
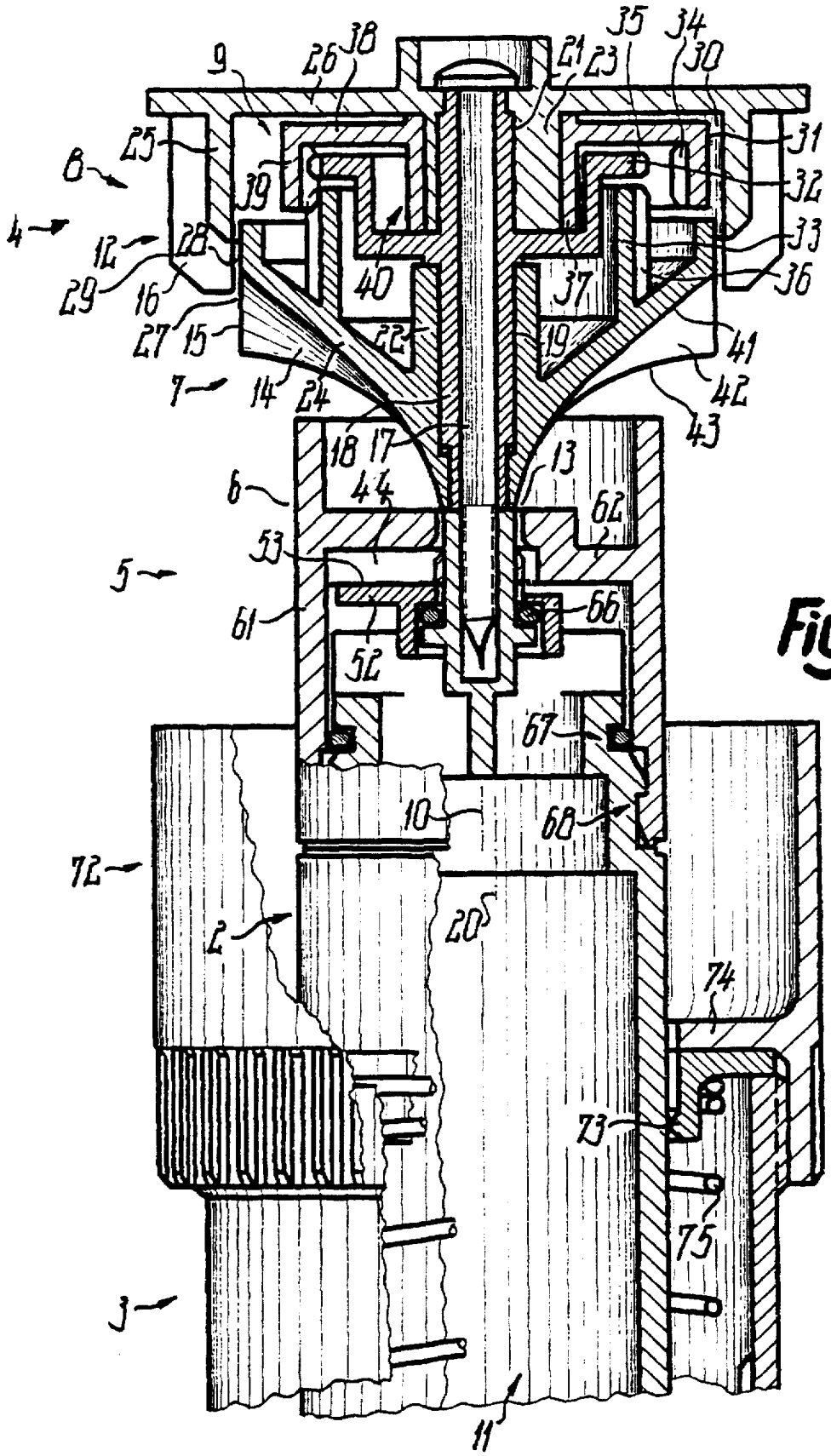

The sprinkler 1 in the drawings has a sleeve-like or tubular, cylindrical base 2, which is movably mounted with one end in telescopically movable manner in a shaft-like or similar, further support 3 and on the other, upper end carries a discharge head 4 for discharging the water. Immediately adjacent to the head 4 projecting over the tubular section of the base 2 and axially adjacent to the tubular portion is provided an adjusting device 5 for varying the discharge characteristics and which is adjusted with a sleeve-like handle 6 having roughly the same external cross-section as the tubular section of the base 2 and forms a continuous extension of the tubular section approximately up to the bottom of the head 4.

The head 4 has a first guide body 7 and a second guide body 8, which engage in one another with their facing ends in approximately axially parallel or equiaxial manner and being arranged in such a way that they form interconnected longitudinal portions of water guides. The two guide bodies 7, 8 are interconnected by means of a control or driving mechanism, e.g. a gear 9, which in the same way as the guide bodies 7, 8 is located roughly in the axis 10 of at least one of the units 2 to 8, said axis 10 being usually roughly vertical in operation. The water is supplied by means of a fluid inlet 11 located at the lower end of the unit 2 and/or 3, e.g. by means of a non-destructively detachably connected hose, flows successively through the units 5 to 8 and leaves the head 4 in the vicinity of a fluid outlet 12 formed by the outer circumferences of both guide bodies 7, 8, the guide body 7 being supplied by a distributing or directional nozzle 13, which determines on which stationary arc angle the guide bodies 7, 8 are supplied with water.

Figure 2:
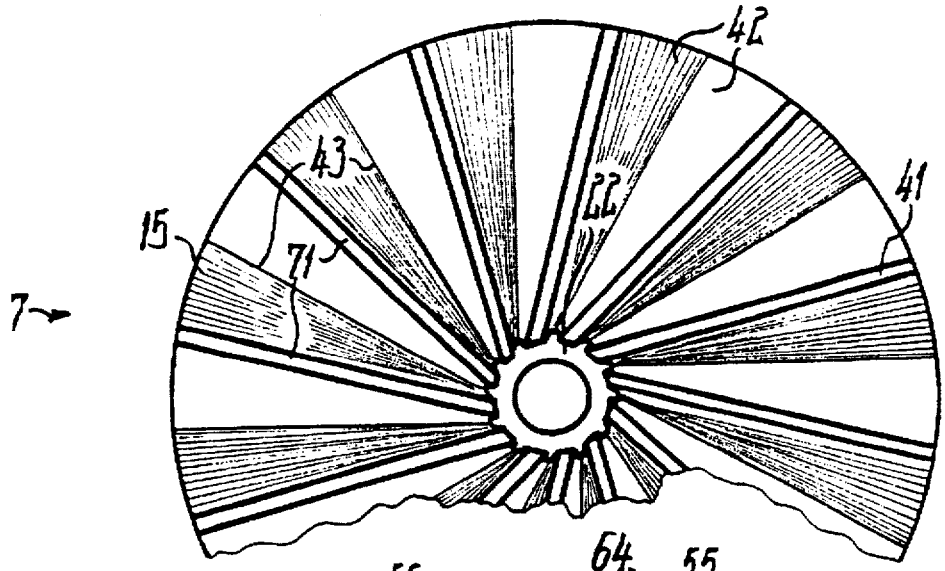

The guide body 7 is directed with its lower ends towards the guide faces 14 connected to the nozzle 13 and which by corresponding shaping deflect the upwardly flowing water with initially increasing and then constant pitch in acute-angled manner outwards away from the axis 10, so that it leaves the guide body 7 under an angle of approximately 45° and in an upwardly sloping direction. The guide faces 14 uniformly distributed about the axis 10 are laterally bounded by rib-like projections or blades 15, which in the same way as the guide faces in FIG. 2 are so inclined in the same direction from the inflow to the Outlet end by a limited spiral pitch of a few radians about the axis 10, that the water flowing under pressure exerts on the guide body 7 a driving torque about the axis 10. The guide body 15 has corresponding turbine blades 16 roughly parallel to the axis 10 and projecting freely against the inlet end of the guide body 7 and against which the water passing out of the body 7 flows under the action of a driving torque, which about the axis 10 is directed in the same sense as the indicated driving torque of the guide body 7. Part of the water jet can pass directly out of the guide body 7 in the trajectory whilst bypassing the guide body 8 or the blade 16, whereas the other part adequately drives the guide body 8.

For mounting the particular unit 4 to 9 a holding member, e.g. a bolt or spindle 17 is provided, whose shank end is fixed in a sleeve-like bracket of the base 2 located within the handle 6, the bracket being positioned axially adjacent to the tubular portion of the base 2 and is connected in one piece thereto by means of radial and/or axial ribs. Adjacent to and connecting onto the upper front face of the bracket the bolt 17 is surrounded by a fixed bearing sleeve 18, to whose end remote from the bracket is braced the head of the bolt 17, so that the bearing sleeve 18 is positioned in radial and/or axial clearance-free manner relative to the body 2 or forms an extension of the sleeve-like bracket. The guide bodies 7, 8 are rotatably mounted independently of one another with axially immediately adjacent, approximately identically dimensioned bearings 19, 21 on the outer circumference of the bearing sleeve 18 or in each case with a sleeve-like hub 22, 23. However, the outer circumference of the hub 23 of the guide body 8 is located eccentrically to the axis 10 in the parallel axis 20. The extent of the eccentricity is much smaller than the radius of the hub 23 of the bearing faces 19 21.

On the outer circumference the guide body 7 has an at least partly approximately acute-angled, closed jacket 24 widened conically in the flow direction and on whose outer circumference are located the guide face 14 or the blades 15 constructed in one piece therewith. The smallest outside width of the jacket 24 in the vicinity of the nozzle 13 is roughly the same as the outside width of the bearing sleeve 18 or bearing faces 19, 21, whilst the greatest width provided at the other end exceeds the axial length of the jacket, which at this end has a cylindrical end portion engaging in a jacket 25 of the guide body 8. The jacket 25 is internally and/or externally approximately cylindrical and has a length which is much smaller than half its width. The free, lower front face of the jacket 25 forms a sloping extension of the guide faces corresponding to the outlet ends of the guide faces 14 and over which the guide blades 16 project axially and freely. However, they do not project over the inner circumference and instead terminate flush therewith and are guided along the outer circumference up to a front wall 26 from which the jacket 25 projects axially. The front wall 26 or a cover covering the latter forms the top end face of the head 4, the head of the bolt 17 engaging on the front wall 26 in such a way that as a result the guide bodies 7, 8 and the rotor of the gear 9 are jointly positively secured in axial manner with respect to the base 2. The blades 16 form stiffening ribs for the jacket 25 and are in turn reinforced by the latter, the number of blades 15, 16 of the two guide bodies 7, 8 uniformly distributed about the axis 10 being roughly the same.

The ends of the slot-like guide faces 14 form a corresponding number, e.g. at least eight or ten or max fourteen or eighteen radially outwardly directed water outlets 27, which are axially covered over part of their axial extension, in passing, by the blades 16 and are only separated from the latter by a very small axial gap 28, namely a small radial clearance. From the outlet 27 water passes out between adjacent blades 16 or against their radially inner axial edges, the blades 16, in axial view, tapering in cutting edge-like manner or wedge-like acute-angled manner radially inwards, so that the water jet is divided by the cutting edge and along the flanks of the blades 16, when the latter passes through the jet. If no blade 16 is in the vicinity of the passing out water jet, the latter passes in unhindered, undivided form into the trajectory. Otherwise the water leaves the head 4 in the vicinity of the outlets 29, which are located in a cylindrical envelope contacting the radially outer sides of the blades 16 and whose diameter is larger than the corresponding envelope of the outlets 27 by roughly half the width of the blades 16. In the vicinity of the outlets 29 the water is completely detached from the head 4.

The guide bodies 7, 8 bound a gear chamber 30, which can be easily opened by axial pulling apart of the two guide bodies 7, 8, if beforehand the bolt 17 has been non-destructively detached. On the circumference the gear chamber 30 is only bounded by the jacket 25, on the upper front side by the front wall 26 and on the lower, facing front side by the guide body 7. In the gear chamber 30 are provided in telescoped form three first, second and third gear members 31, 32, 33, which mesh by means of gear rims 34, 35, 36. The first driving or braking gear member 31 constructed as an outer rotor is rotatably mounted with a hub 37 about the axis 20 on the outer circumference of the hub 23 and is positioned with a ring disk-like front wall 38 connecting the hub 37 to a jacket 39 immediately adjacent to the front wall 26. On the inner circumference of the jacket 39 projecting freely against the guide body 7 is located the associated gear rim 34 located in the axis 20, which during operation rotates about the axis 10, because through the eccentric mounting a crank gear 40 is formed by means of which the gear member 31 is driven by the guide body 8 or some other rotor.

The second gear member of this gear stage constructed in the manner of a planetary gear is constructed as a stator in fixed manner with the base 2 or is connected to the bearing sleeve 18 and can be constructed in one piece therewith. This cup-shaped gear member 32 has its front wall between the bearings 19, 21, has a jacket directed against the front wall 38 and immediately adjacent to said front wall 38 has a radially outwardly projecting collar with the associated gear rim 35 on the outer circumference. Thus, in the manner of a planet rotor, the gear rim 34 is only in engagement in a very limited circumferential area with the gear rim 35 or 36 located in the axis 10 and which engages immediately adjacent to the gear rim 35 in the gear rim 34 and is provided as an external tooth system on the outer circumference of the gear member 33.

This sleeve-like gear member 33 can be constructed in one piece with the jacket 24, is located with a radial spacing within the jacket 24 and projects axially over its end or further than the hub 22, which in the same way as the hub 23 is axially supported against the front wall of the gear member 32. The end faces of the jackets 24, 39 pointing against one another are immediately adjacent to one another and the outer circumference of the gear member 31 or the jacket 39 extends approximately up to the inner circumference of the jacket 25, which leads to a radially and axially very compact construction. The number of teeth of the gear rims 34 to 36 can differ, e.g. by one tooth, the outer tooth system 36 being able to have less teeth than the outer tooth system 35 or the inner tooth system 34. The different center distance with respect to the inner tooth system 34 due to the different number of teeth of the outer tooth systems 35 and 36 is compensated by profile shifting in known manner, so that both outer tooth systems 35 and 36 have the same centre distance with respect to the inner tooth system 34.

Thus, the reduction ratio from the guide body 8 to the guide body 7 can be approximately 47:1, so that the guide body 7 e.g. only performs max 20 revolutions per minute. The rotation direction of the two guide bodies 7, 8 is the same and in the same direction as the driving torques. The guide bodies 7, 8 start up, as a result of the construction according to the invention, when there is a very small water passage, the speed of the guide body 7 being approximately independent of the water pressure and the water flow quantity. Excessive speed of the guide body 7 is prevented by a braking action, the speed of the guide body 8 in permanent operation being proportional to and no faster than the water flow speed. The driving torque acting through the water on the guide body 7 would give the latter, if it was not subject to a braking action, a much higher speed.

For the favourable subdivision of the water into individual, roughly identical water jets distributed about the axis 10, the bottom face 41 of the guide face 14 can have the indicated pitch up to the outlet 27 and is so flanked in acute-angled manner, e.g. under an angle of max 75°, min 45° and in particular approximately 60°, that in cross-section the flanks 42 are approximately symmetrical to the middle plane through the bottom face 41. The two remote flanks 42 of two adjacent guide faces 14 pass into one another in acute-angled manner by means of an apex or comb or crest 43 of the associated blade 15, because the latter forms the flanks 42 and separates from one another the slot-like guide faces 14. The flanks 42 may only start with an axial spacing from the inlet end of the guide faces 14, said spacing being larger than the radius or diameter of the outer circumference of the jacket 24 in the vicinity of said inlet end and said outer circumference is concially progressively widened or at an acute angle for forming an initially closed envelope flow. The guide slot 14 is widened in cross-section towards the open slot side over at least part of its height and in particular up to the open slot side, the slot or blade height at the inlet end being zero and increases constantly to progressively in the flow direction. The flanks 42 or the particular crest 43 then rise from a zero or minimum height with respect to the outer circumference of the jacket 42 or bottom face 41 so that the crest 43 rises under a larger angle or with greater curvature in concave or linear manner and in the exit envelope face is directed roughly radially to the axis 10. The axial extension or height of the blade 15 in the vicinity of the outlet 27 can be smaller than the circumferential spacing of the crests 43 of adjacent blades 15 in this area. In radial view or in cross-section at right angles to the flow direction the blades 15 are acute-angled triangular, their crests 43 being sharp-edged and/or rounded or flattened. The inside width of the guide face 14 increases constantly in the flow direction.

The adjusting device 5 or other means for regulating the water flow has eight openings or control openings 44 to 51 in a row adjacent and around an axis 10 and their outlets and/or inlets are located in a common plane and have spacings which are significantly smaller than the associated extension of the particular control opening. The control openings or their inlets or outlets along the row decrease in cross-section from the largest opening 44 in stepwise approximately uniform manner to a smallest opening 51 and are uniformly distributed around the axis 10. Their boundaries located on a longitudinal side of the row are aligned, because they have identical radial spacings from the axis 10, whereas the boundaries remote therefrom have stepped decreasing spacings from the inner boundary and both boundaries are curved round the axis 10. The adjacent or facing lateral boundaries of the openings are approximately linear throughout, diverge with respect to the stepped boundaries in acute-angled manner and have corresponding stepped lengths, adjacent lateral boundaries of adjacent openings being parallel to one another and having a limited reciprocal spacing.

For modifying the passage cross-section of approximately each of said openings between full opening width and full opening closure a corresponding through, disk or plate-like control member 52 is provided, which covers or frees the particular control opening at the inlet and/or outlet. The through, planar control face 23 is provided here only on the inlet sides of the control openings and then slides in substantially pressure-tight manner on the opposite faces, which are located between the control openings and on either side immediately adjacent to the longitudinal sides of the row of openings. The control member 52 in the configuration explained relative to the control openings has stepped control portions 54 to 60, which decrease in stepped manner along a corresponding row from a maximum control portion 54 to a minimum control portion 60, but on the stepped, outer longitudinal or circumferential side are inwardly set back in each case by roughly the same amount with respect to the circumferential side of the associated control opening. Thus, with the smallest control opening 51 there is no need to associate the smallest control portion.

Compared with the width of a control opening, each control portion is larger roughly by the width of the spacing between adjacent control portions, on the inner circumference or the control portions are bounded in circular or concave, joint through manner around the axis 10 and the radially outer boundaries of the control portions are concavely curved around the axis 10 with respect to the in each case adjacent control portion abruptly stepped approximately at right angles. The control openings 44 to 51 pass through a front wall, whose side sliding on the control face 53, like the control face, is at right angles to the axis 10 and forms an adjusting member firmly connected to a jacket 61. The front wall 62 is at a smaller distance from the upper than from the lower end of the jacket 61 constructed in one piece therewith and which forms a casing completely surrounding the control faces, the control member 52 being located on the underside of the control wall 62. The outer circumference of the jacket 61 forms the handle 6, which during discharge operation is positioned freely between the units 2, 3 and the unit 4, but has a smaller outside width compared with the latter.

Figure 3:
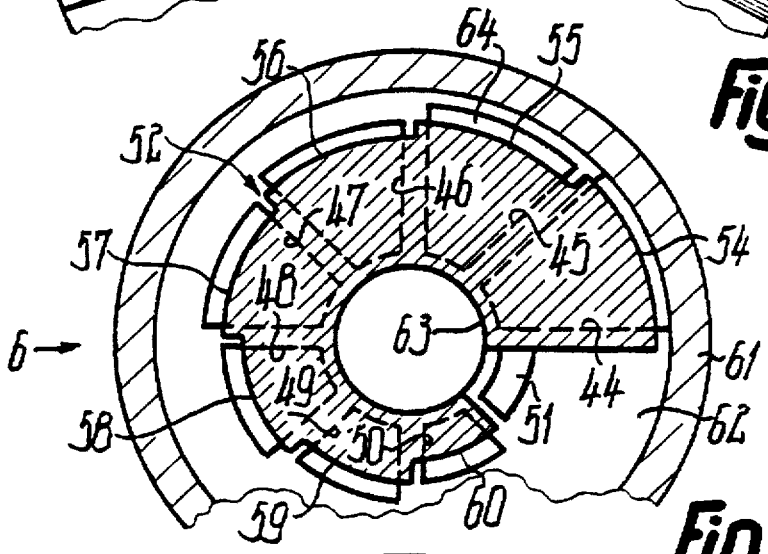

The adjusting device 5 can be steplessly adjusted by rotating the handle 6, but appropriately several and in particular a number of preferred positions corresponding to the number of control openings 44 to 51 are palpably determined and fixed by resilient locking and can only be overcome by applying a more vigorous actuation of the handle 6. In a preferred position according to FIG. 3 all the control openings are freed at least in their radially outer area and with the exception of the smallest control opening 51, all the remaining control openings have the radially inner area closed and consequently only the radially outer area is freed as the opened passage cross-section 64, whilst the smallest opening 51 can be completely freed. The sum of the passage cross-sections 64 then corresponds roughly to the greatest to be freed or total passage cross-section of the largest control opening 44, the width of each cross-section 64 being constant in the circumferential direction up to one or both lateral boundaries of the associated control opening or is roughly the same for all the control openings. Thus, through the roughly identical passage cross-section 64 roughly uniformly water passes out over an arc angle of 360° around the axis 10.

Figure 4:
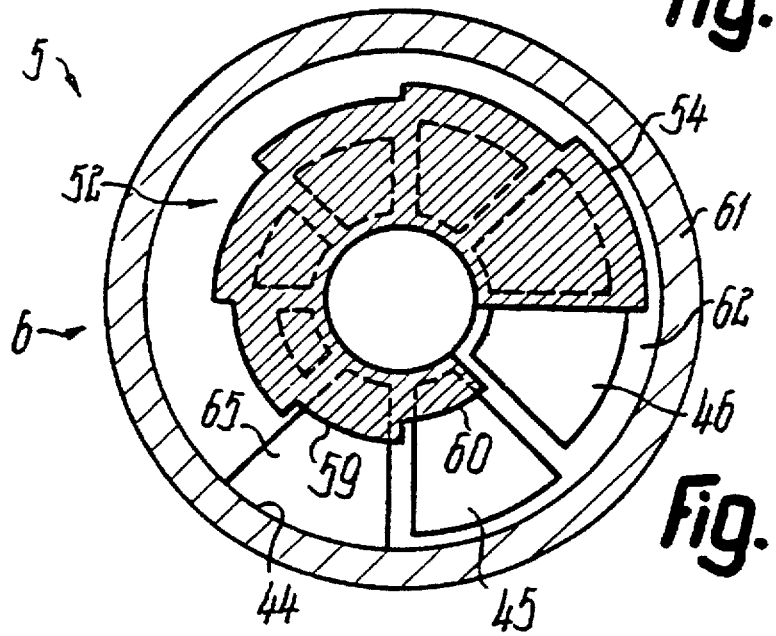

With the setting according to FIG. 4 said arc angle is only 135°, because the five smallest control openings 47 to 51 are completely closed, the two largest control openings 44, 45 are radially inwardly only partly closed and the third largest control opening 46 is freed to its full width. Each random control opening can be freed to its full width or can be closed to a randomly large, radially inner portion. The passage cross-section 65 of each freed control opening 44 to 46 is consequently larger than the corresponding passage cross-section 64 according to FIG. 3, but the sum of all the passage cross-sections 65 according to FIG. 4 is once again roughly the same as the sum of all the passage cross-sections 64 according to FIG. 3, which applies for each of the preferred or locked positions. With a decrease of the arc angle or the number or row extension of the passage cross-sections, there is consequently an increase in the individual passage cross-section 65. The largest control opening 44 can extend up to the inner circumference of the jacket 61, whilst the radial extension of the smallest opening 51 can roughly correspond to the transverse or radial extension of a passage cross-section 64.

In the flow direction to the outlet sides is connected a central directional opening 63 of the directional nozzle 13 common to all the control openings 44 to 51 and which in uninterrupted through and annular manner is formed on the outer circumference by an axial portion of the front wall 62 directly connected to the control openings and on the inner circumference by a fixed bolt, e.g. the bracket for the unit 17, 18 firmly connected in one piece to the base 2. The outer circumference of the directional nozzle 13 has a smaller radial spacing from the axis 10 than the inner boundaries of the control openings, which are line-connected by means of corresponding transverse ducts, e.g. chamfers, radially inwardly directed and separately to the directional opening 63. The water flowing through the flow cross-sections 64, 65 is guided radially inwards by the area of the associated control opening covered by the control member 52 and is then deflected transversely or axially into the directional nozzle 13 out of which the water passes with the in each case set arc angle into the inlet side of the guide body 7 or guide faces 14. The outer circumference of the jacket 24 or guide faces 14 roughly corresponds to the inner circumference or the envelope face of the radially inner boundary of the directional nozzle 13, which could also be formed by individual ducts distributed over the circumference. The control member 52 is positioned with a hub in axial and/or radially fixed manner on the outer circumference of the bracket and is sealed with respect thereto by a ring seal 66, so that it can be upwardly drawn off in non-destructive manner for disassembly purposes in the same way as the units 7, 8, 9, 17, 18, 31, 32, 33, 61, 62.

The units 6 or 61, 62 are oppositely movable parallel to the adjusting direction with a bearing 67 or are mounted in rotary manner on the upper end of the base 2 over more than a full rotation, the outer circumference of the handle 6 forming an approximately continuous extension of the outer circumference of the base 2 having the same outside width and projects upwards with the smaller bracket over the upper end of its exposed outer jacket into the handle 6, into which projects from above the lower, tapered end of the guide body 7. Thus, the upper end of the jacket 61 in the discharge operation forms an outer shield for the water guidance in the guide body 7, whose axial spacing from the crests 43 is much smaller than ½, ⅓ or ¼ of its inside width.

The friction bearing 67 encloses a seal and a snap connection 68 of the adjusting body 6 with respect to the upper end of the base 2, which engages in sleeve-like manner in the lower end of the jacket 61, on the outer circumference forms a ring-like snap member and secures the body 6 against axial drawing off and in substantially axial and/or radial clearance-free manner. For assembly purposes the body 6 only has to be axially engaged on the associated end of the base 2 and pressed down axially, so that the snap connection in the axis 10 initially is resiliently released and then automatically positively locks in. The control face 53 of the preassembled control member 52 resiliently engages in functionally correct manner on the front wall 62 pretensioned under the action of the seal 66.

Figure 5:
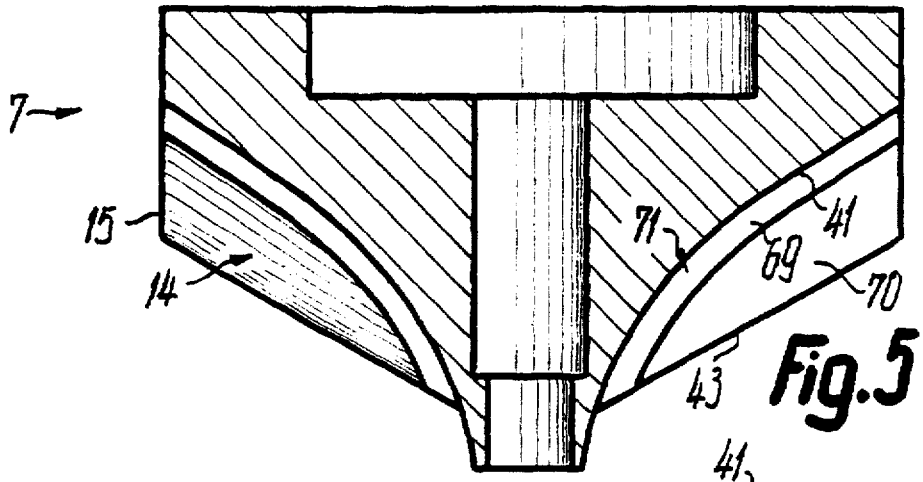
Figure 6:
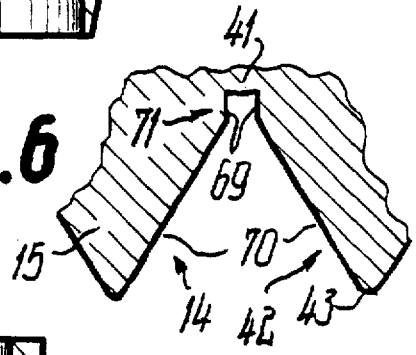

As can in particular be gathered from FIGS. 2, 5 and 6, the flanks 42, in cross-section, can diverge from the planar shape or at right angles to the flow direction can have angularly stepped flank portions 69, 70 and the bottom 41 can diverge from the concavely curved or semicircular shape, e.g. can be planar following onto the flank portion 69 engaging in right-angled manner thereon. These, parallel facing flank portions 69 are much lower than the connecting flank portions 70, which diverge under an angle of approximately 60° uniformly up to the crests 43 and can be at least five and at the most fifteen times higher than the flank portion 69, passing into the associated flank portion 69 in each case accompanied by the formation of a projecting edge. The flank portions 69 form the lateral flanks of an approximately right-angled bottom slot 71 of approximately constant width up to the outlet 27 and which forms the narrowest area of the passage cross-section of the complete slot height extending up to the crests 43 and which in turn can have a slightly smaller slot width than slot height. The particular dimension is min 1 mm and max 2 to 3 mm. It has been found that as a result of these constructions the efficiency of the turbines 7, 8 or the projection width of the water can be increased and improved, particularly by the combination of a cross-sectionally narrowed area 71 and a facing, optionally stepped, widened or widening portion 70.

Figure 7:
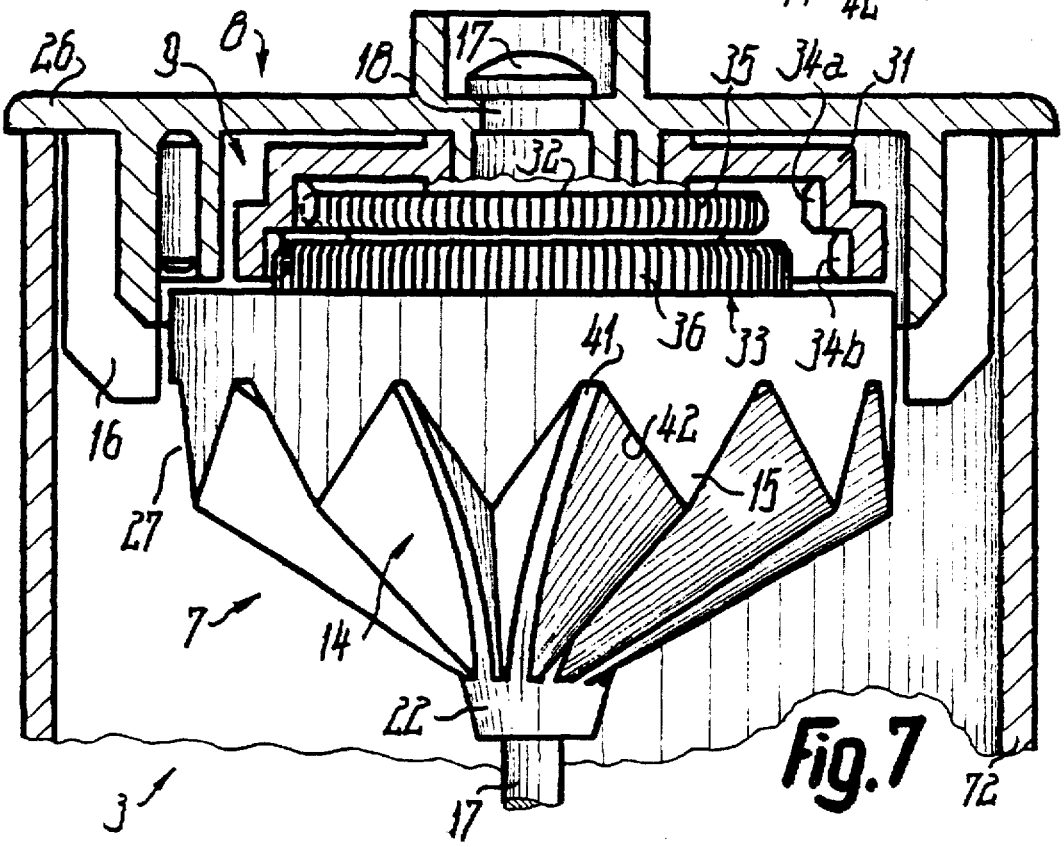

The sprinklers according to FIGS. 1 and 7 are constructed as flush-mounted sprinklers, in which the base 2 with the head 4 is extendable in stop-limited, upwards manner into the working position according to FIG. 1 and can be so downwardly introduced into a sunk position in the support 3 that the head 4 or front wall 26 with its ring edge projecting radially over the fluid outlet 12 and blades 16 forms a covering closure for the upper end of the support 3. The upper end is formed by a sleeve-like end termination 72, which by means of a thread connection located in the axis 10 is fixed in rigid manner to the upper end of the support 3, braces with a partition 74 a ring seal 73 sliding on the outer circumference of the base 2 against the upper end of the support 3 and has a slightly widened outer circumference compared with that of the support 3. Against the partition 74 is also supported a return spring 75 located within the support 3 and surrounding the base 2 and which jointly returns the units 2, 4, 5 back downwards into the support 3 when the water pressure transferring these units into the extended position and maintaining them therein is correspondingly reduced. The water supplied to the head 4 acts at the inlet end of the support 3 within a corresponding cylinder chamber on a piston at the lower end of the base 2. In the inserted state said water-exposed surfaces of the units 4, 5 and the handle 6 are completely closed to the outside by the support 3 or casing 72, the units 61, 67, 68 projecting into the base 3 and the seal 73 sealingly engaging in spaced manner between these ends on the outer circumference of the jacket 61.

According to FIG. 7, instead of being provided with one the first gears member 31 is provided with two separate engaging or gear rims for the second and third gear members 35, 36, so that the transmission ratio can be randomly increased or decreased. As a result of reciprocal stepping the two gear rims **34*a*, 34*b* have different diameters or tooth numbers and in this case the gear rim 35 rolls in eccentric rotary manner, has a smaller diameter than the gear rim 34*b* for the correspondingly rolling gear rim 36 of the gear member 33**.

If in the inoperative or starting position according to FIG. 7 the sprinkler is supplied with pressurized water from the fluid inlet, said water raises the units 2 and 4 to 6 into the position according to FIG. 1 and flows simultaneously within the base 2 up to the adjusting device 6 and through the latter to the guide bodies 14, 16, so that at the latest on reaching the extended position the guide bodies 7, 8 are exposed by the flowing water to the equidirectional driving torque about the axis 10 and start to rotate in the same direction with significantly differing speeds. With the set arc angle the water is discharged in focussed form with a large projection width and fans out further with increasing projecting distance from the sprinkler head 4, so that adjacent water jets cover one another before reaching the ground, but through the rotation of the guide body 7, in plan view, are not or are only insignificantly subject to a curvature or fanning. Substantially all the indicated components can be made from plastic or as injection mouldings.

We claim:

1. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation; and, mechanical control means for letting said first and second operating runners mutually perform a substantially constant and continuous relative motion during said discharge operation.

2. The sprinkler according to claim 1, wherein said relative motion is substantially uninterrupted and steady during substantially entirely all of said discharge operation when a feed pressure for feeding the fluid to said fluid inlet remains substantially constant, said first and second operating runners being drivingly interconnected by a ratio corresponding to said relative motion.

3. The sprinkler according to claim 1, wherein said first guide body includes at least one of a fluid divider, a fluid driven recoil rotor, and a fluid directing body having at least one fluid exit directed outwards away from said first guide body.

4. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation;

in said discharge operation, said first operating motion being oriented substantially unidirectional with said second operating motion in said discharge operation;

said relative motion and said second operating motion being continuously substantially constant with respect to a motion speed; and, said second operating runner being located downstream of said first operating runner.

5. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation;

said first operating runner having a fluid outlet directed against fluid guide faces of said second operating runner; and, in said discharge operation, said first operating motion being multiply slower than said second operating motion.

6. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation;

said first guide body providing a length section including fluid guide faces for continuously transversely deflecting the fluid;

said first guide body being mounted to provide a continuously slow running rotor rotating about an axis substantially parallel to at least a partial longitudinal section of said length section; and, said second operating motion being faster than said first operating motion.

7. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation;

turbine drive means for driving at least one of said operating runners, at least one of said operating runners including a turbine rotor;

said second operating runner controlling said first operating motion of said first operating runner via said control means; and, in said discharge operation said turbine rotor being axially positionally substantially stable with respect to said base, said second operating runner being located downstream of said first operating runner.

8. A sprinkler for discharging a fluid into an open environment in a continuous discharge operation, comprising: a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, wherein said control means include a gear unit for controlling said operating motion of said first guide body, said gear unit including first, second, and third gear members, said second gear member including a stator drivingly engaging said first gear member, said stator being substantially stationary with respect to said base.

9. The sprinkler according to claim 8, wherein said first gear member is provided for driving and retarding said operating motion of said first guide body.

10. The sprinkler according to claim 8, wherein said first gear member is rollingly engaging said stator successively along a stator path.

11. The sprinkler according to claim 8, wherein said first gear member is rollingly engaging said third gear member successively along an engagement path.

12. A sprinkler for discharging a fluid into an open environment in a continuous discharge operation, comprising: a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, wherein a first gear member is provided for driving at least one of said guide bodies, said control means including at least one second gear member mounted eccentrically with respect to said first gear member.

13. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation; and, said control means including a crank drive including a crank member rotating about an excenter axis, said excenter axis being eccentric with respect to a central axis of said first and second operating runner.

14. A sprinkler for discharging a fluid into an open environment in a continuous discharge operation, comprising: a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, where in said control means include first and second gear members, said first gear member including an external rotor and having an inner circumference drivingly engaging an outer circumference of at least one of said second gear member.

15. A sprinkler for discharging a fluid into an open environment in a continuous discharge operation, comprising: a base, a fluid inlet, a fluid outlet, and first and second guide bodies for fluiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, wherein said control means include a first gear member rotatably mounted on an eccentric of said second guide body.

16. A sprinkler for discharging a fluid into an open environment in a continuous discharge operation, comprising: a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, wherein said second guide body includes a casing cup, said control means including a first gear member located substantially entirely within said second guide body.

17. A sprinkler for discharging a fluid into an open environment in a continuous discharge operation, comprising: a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, wherein said control means include a first gear member including a cup casing, said cup casing having an end wall and a jacket wall, said second guide body including a cover wall and an enveloping wall, at least one of said walls, of said first gear member being located directly adjacent to at least one of said walls of said second guide body.

18. A sprinkler for discharging a fluid into an open environment in a continuous discharge operation, comprising: a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, wherein said control means include a first gear member simultaneously engaging second and third gear members in the vicinity of engagement points, said engagement points being directly juxtaposed.

19. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation;

a sprinkler axis is defined, the fluid being discharged from said final fluid outlet in a ballistic trajectory directed away from said sprinkler axis and defining trajectory distances from said sprinkler axis and at least one extension angle around said sprinkler axis and at said fluid outlet; and, setting means for varying the at least one extension angle to fixed but manually variable setting states.

20. The sprinkler according to claim 19, wherein the at least one extension angle is variable, by at least one of stepwise and continuous motion, between substantially 45° and 360°.

21. The sprinkler according to claim 19, wherein said setting means are operable to establish at least three said setting states, in each of said setting states said setting means defining an overall passage cross-section for passing the fluid downstream of said fluid inlet (11), in at least three of said at least two setting states said passage cross-section being substantially equally large.

22. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation;

the fluid being environmentally discharged at said fluid outlet in a fluid flow defining flow characteristics; and, adjusting means for operationally varying at least one of said flow characteristics, said adjusting means including a plurality of control openings juxtaposed fixedly in a row and a control member positionally adjustable along said row for varying at least one of said flow characteristics, said control member being displaceable along a control plane and in a control direction.

23. The sprinkler according to claim 22, wherein said control openings include at least three through openings for passing the fluid, each of said passage openings defining an individual passage cross-section, said control member being provided for varying said individual passage cross-section of at least one of said control openings and for closing at least one of said control openings.

24. The sprinkler according to claim 22, wherein said control openings are arranged around a control axis and include opening sides located adjacent to said control axis, at least two of said opening sides being at least one of substantially equally extended around said control axis, and substantially equally spaced from said control axis.

25. A sprinkler for discharging a fluid into an open environment in a continuous discharge operation, comprising: a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, and, wherein the fluid is environmentally discharged at said fluid outlet in a fluid flow defining flow characteristics, said sprinkler including adjusting means for operationally varying at least one of said flow characteristics, said adjusting means including a plurality of control openings fixedly juxtaposed in a row, a control member being provided and positionally adjustable along said row for varying at least one of said flow characteristics, said control member being displaceable along a control plane and in a control direction, wherein parallel to said control direction and said control plane said control openings and said control member include following control sections in an extension direction transverse to said control direction at least two of said control sections having different extensions.

26. A sprinkler for discharging a fluid into an open environment in a continuous discharge operation, comprising:

a base and a flow path including a fluid inlet and a final fluid outlet, said final fluid outlet directly issuing into the open environment;

first and second guide bodies including first and second environmentally exposed operating runners for guiding the fluid along the flow path, said operating runners being directly interconnected and located between said fluid inlet and said final fluid outlet, said operating runners being substantially coaxial and performing first and second operating motions during said discharge operation;

mechanical control means for letting said first and second operating runners mutually perform a substantially constant and continuous relative motion during said discharge operation;

the fluid being discharged in a discharge flow; and;

setting means for manually varying said discharge flow via a single manual setting motion, including a freely exposed and manually accessible handle for effecting said single manual setting motion, said handle being coaxial with said first and second operating runners.

27. The sprinkler according to claim 26, wherein said handle is located and accessible outside said discharge flow, said handle being set back with respect to said fluid outlet.

28. The sprinkler according to claim 26, wherein said sprinkler defines a central axis and said first separating runner has fluid guide faces including a fluid inlet end, said handle being located substantially coaxial to said central axis and including a handle sleeve, said handle sleeve defining sleeve ends and having an annular partition spaced from said sleeve ends and located between said sleeve ends, said partition bounding control openings and an annular fluid passage directly connecting to said fluid inlet end of at least one of said guide faces.

29. A sprinkler for discharging a fluid into an open environment in a continuous discharge operation, comprising:

a base, a fluid inlet, a fluid outlet, and first and second guide bodies for guiding the fluid along a flow path, with respect to said flow path said guide bodies being interconnected and located between said fluid inlet and said fluid outlet, during said discharge operation at least one of said guide bodies including an operating runner performing an operating motion, wherein control means are provided for letting said first and second guide bodies mutually perform a relative motion while said discharge operation is performed, wherein at least one of said guide bodies includes at least one guide face for guiding the fluid in a flow direction, said guide face including a lateral flank of an oblong depression extending along said flow direction, in cross-section transverse to said flow direction said lateral flank commonly including directly interconnecting first and second flank portions said first flank portion connecting to a depression bottom of said depression and being orient with respect to said second flank portion at a salient angle.

30. A sprinkler for discharging a fluid into an open environment in a continuous discharge operation, comprising:

a base, a fluid inlet, a fluid outlet, and first and second guide bodies for guiding the fluid along a flow path, with respect to said flow path said guide bodies being interconnected and located between said fluid inlet and said fluid outlet, during said discharge operation said first guide body including an operating runner performing an operating motion, wherein said first guide body includes a longitudinally extending oblong groove for guiding the fluid, said groove including an ultimate bottom face, said bottom face being substantially planar, in cross-section said groove defining a groove width extension increasing away from said bottom face.

31. A sprinkler for discharging a fluid into an open environment in a continuous discharge operation, comprising:

a base, a fluid inlet, a fluid outlet, and first and second guide bodies for guiding the fluid along a flow path, with respect to said flow path said guide bodies being interconnected and located between said fluid inlet and said fluid outlet, during said discharge operation said first guide body including an operating runner performing an operating motion, wherein for guiding the fluid said first guide body includes a longitudinal groove, said groove including a bottom area providing a slot along at least part of said groove, said slot being bounded by opposing slot flanks oriented substantially parallel, opposing flank portions connecting to said slot flanks, in cross-section said flank portions diverging away from said bottom area, and being larger than said slot flank when seen in cross-section.

32. A sprinkler for discharging a fluid into an open environment in a continuous discharge operation, comprising:

a base, a fluid inlet, a fluid outlet, and at least one guide groove for guiding the fluid, in cross-section said guide groove including opposing groove flanks and a groove bottom connecting at angles to both said groove flanks, wherein in said cross-section at least one of said groove flanks includes first and second flank portions, said first flank portion directly connecting to said groove bottom at a first angle, said second flank portion directly connecting to said first flank portion at a second angle larger than said first angle, said guide groove defining a longitudinal median plane opposing said at least one groove flank, away from said first flank portion said second flank portion diverging with said longitudinal median plane.

33. A sprinkler for discharging a fluid into an open environment in a continuous discharge operation, comprising:

a base, a fluid inlet and a fluid outlet; and, at least one guide groove for guiding the fluid, said guide groove including, in cross-section, opposing groove flanks and a groove bottom connecting at angles to both said groove flanks, said groove bottom providing an ultimate bottom face, said ultimate bottom face being substantially planar, and said guide groove defining, in cross-section, a groove width extension increasing away from said ultimate bottom face.

* * * * *